US006405948B1

(12) United States Patent
Hahn et al.

(10) Patent No.: US 6,405,948 B1
(45) Date of Patent: Jun. 18, 2002

(54) LIBERATING INTRACELLULAR MATTER FROM BIOLOGICAL MATERIAL

(75) Inventors: William E. Hahn, Aurora; Charles A. Arnold, Englewood, both of CO (US)

(73) Assignee: PulseWave LLC, Englewood, CO (US)

( * ) Notice: Subject to any disclaimer, the term of this patent is extended or adjusted under 35 U.S.C. 154(b) by 0 days.

(21) Appl. No.: 09/385,152

(22) Filed: Aug. 30, 1999

Related U.S. Application Data

(63) Continuation-in-part of application No. 09/290,483, filed on Apr. 12, 1999, now Pat. No. 6,135,370, which is a continuation of application No. 08/897,015, filed on Jul. 18, 1997, now abandoned.

(51) Int. Cl.[7] ..... B02C 19/12; B02C 19/18

(52) U.S. Cl. ..... 241/1; 241/2

(58) Field of Search ..... 241/1, 301, 2

(56) References Cited

U.S. PATENT DOCUMENTS

| | | | | |
|---|---|---|---|---|
| 2,750,120 A | | 6/1956 | Pallmann | |
| 3,556,414 A | * | 1/1971 | Eberly | 241/2 |
| 3,679,139 A | * | 7/1972 | Schneyour et al. | 241/2 |
| 3,687,180 A | | 8/1972 | Michalon | |
| 4,151,794 A | | 5/1979 | Burkett | |
| 5,330,913 A | | 7/1994 | Nakayama | |
| 5,747,088 A | | 5/1998 | Fletcher | |

FOREIGN PATENT DOCUMENTS

| | | |
|---|---|---|
| FR | 2701664 A | 8/1994 |
| GB | 143196 A | 6/1921 |
| SU | 794072 B | 1/1981 |
| SU | 1292797 A | 2/1984 |
| SU | 1286232 A | 1/1987 |
| SU | 1663021 A | 7/1991 |
| WO | 99 03589 A | 1/1999 |

* cited by examiner

*Primary Examiner*—Mark Rosenbaum
(74) *Attorney, Agent, or Firm*—Jonathan Wainer

(57) ABSTRACT

A method of liberating intracellular matter from biological material having cells with cell walls includes subjecting the biological material to rapid pressure increases and decreases, and exceeding the elastic limit of the cell walls with the pressure increases and decreases, thereby opening the cell walls and liberating the intracellular material from the cells. This produces a heterogenous mixture of cell wall fragments and the intracellular material. Where the biological material includes pieces of plant animal or fungal material, the method can further include separating the cells of the pieces from each other with the pressure increases and decreases when the elastic limit of intercellular bonds are exceeded. Water and volatiles in the biological material is liberated and vaporized, producing a substantially dry mixture having a lower water content than the original material.

34 Claims, 7 Drawing Sheets

LIBERATING INTRACELLULAR MATTER FROM BIOLOGICAL MATERIAL

CROSS REFERENCE TO RELATED APPLICATIONS

This application is a continuation-in-part of patent application Ser. No. 09/290,483, filed Apr. 12, 1999, which issued on Oct. 24, 2000 as U.S. Pat. No. 6,135,370, and which is a continuation of Ser. No. 08/897,015, filed Jul. 18, 1997 and now abandoned, both to Charles A. Arnold and both entitled "Apparatus And Methods For Pulverizing Material Into Small Particles."

BACKGROUND OF THE INVENTION

This application relates to methods of liberating and extracting intracellular material from plant, fungal, animal and bacterial cells.

Many plants, animals, bacteria, and fungi include useful material within their cells. These materials may be useful in pharmaceuticals, nutritional supplements, lotions, and the like. Others may have agricultural or industrial applications. For example, within the cells of the kava plant there are small granules of kava lactones, which are neurologically active. Pacific islanders cultivate the kava plant and make a sedative tea from chopped up pieces of kava roots, which has about 5–15% kava lactones by dry weight. A powder made from kava plants is sold in a capsule form as a nutritional supplement. However, because of the strength of the cellulose walls of the kava plants, it is difficult to extract the granules of kava lactones.

All plant and fungal cell walls are made primarily of cellulose, which is generally in the form of long, cross-linked strands. Such cell walls, which provide mechanical support for plants and fungi, are necessarily very sturdy and resistant to being easily opened or broken apart by mechanical or chemical means.

One method of breaking open the cell walls to release the material inside is by grinding or milling the plant or fungal material. However, many cell walls are only crushed by grinding or milling and are not substantially broken open. Much desirable material can remain within the shells of the crushed cell walls. Grinding or milling the plant or fungal material mixes together all material from the cells, including the cellulose, which makes it difficult to separate the useful material from unwanted debris. The ground or milled product is impure—the product retains all impurities that were in the stock material before grinding or milling. Because each plant sample may contain a different content of impurities or inactive ingredients, the efficacy of the ground or milled product for its intended purpose can vary widely.

Another method of opening cellulose cell walls to extract intracellular material is with chemicals that break down the cellulose walls. These chemicals may include solvents or acids, which may contaminate the desired material within the cells. Additional processing may be required to remove the chemicals, adding cost to the extraction process. The chemicals also may chemically alter the desired intracellular material, rendering it weakened, useless, or even harmful.

Some material from within cells may be extracted, as with the tea made from kava, by soaking the plant or fungal material in hot or boiling water. This process may leave much of the desired material within the cells. Subjecting the plant or fungal material to high temperatures may also break down the desired material, cause it to react with other material within the cells, or otherwise reduce its efficacy.

SUMMARY OF THE INVENTION

In one aspect, the invention provides a mechanical method of liberating an intracellular material from biological material having cells with cell walls. The method includes subjecting pieces of the biological material to rapidly alternating increasing and decreasing pressures, which may include shock waves, and opening the cell walls with the pressure increases and decreases. This liberates the intracellular material from the cells and produces a heterogenous mixture comprised of cell wall fragments and the intracellular material. It is believed that the rapidly alternating pressures causes the elastic limit of the intercellular bonds to be exceeded, breaking these bonds and separating cells from one another. The elastic limit of the cell walls is also exceeded, causing the cell walls to rend, tear, burst, or otherwise open and further fragment, thereby liberating the intracellular material. The method is particularly useful for liberating interacellular material from plant and fungal matter, which has cell walls formed primarily of cellulose.

In other features of this method, water and volatiles liberated from the cells with the pressure increases and decreases are vaporized such that the mixture has a lower water content and a lower volatile compound content than the biological material. The rapid pressure increases and decreases can also heat the biological material such that the mixture is produced with a temperature above an initial ambient temperature that depends upon the material and operating conditions.

A mill for subjecting the biological material to the pressure changes can include a housing characterized by a first end including an input adapted to introduce the biological material into the housing, a second end including an output adapted to remove the mixture, and longitudinally extending internal sides that form longitudinally extending interior corners where they meet. A rotor assembly within the housing is characterized by a rotatable shaft extending longitudinally through the housing between the first and second ends, and a plurality of rotors coupled to the shaft for rotation therewith. Rotors of the plurality of rotors each include a rotor plate having a peripheral edge forming a plurality of apices, and vanes on a side of the rotor plate which extend approximately radially from respective apices. An orifice plate is positioned between adjacently located pairs of the plurality of rotors. Each orifice plate extends inwardly from the internal sides of the housing to a central aperture which provides an orifice around the shaft. Each of the central apertures are smaller than rotor plates of the corresponding pair of rotors. Circumferentially spaced members, or posts, are located proximate each of the rotors. These members extend inwardly from the corners of the housing toward the rotors such that the vanes pass closely by the members as the rotor assembly rotates.

The biological material is fed into the input while the rotor assembly rotates, typically at speeds over about 2500 rpm, such that the biological material is entrained in a Coanda flow through the housing. Subjecting the biological material to the alternatingly increasing and decreasing pressure includes causing the bioloigical material to flow in an alternating outward and inward flow around peripheral edges of the rotor plates and through the orifices. The pressure on the biological material is alternately increased and decreased as the flow passes through each orifice and expands in the space below each orifice plate. Compression and decompression also occur in the flow as the vanes pass by flats and open corners of the housing sides and also as the vanes pass closely by the inwardly extending members.

These compressions and decompressions may be of different magnitudes and durations. The Coanda flow is substantially without high angle impacts of the biological material on the rotor assembly, the orifice plates or the interior sides of the housing.

The rotors can be angularly offset from each other such that the compressions and decompressions are not synchronized. A series of compressions and decompressions is established at frequencies that depends on the number of rotors, the number of apices on each rotor, the number of sides in the housing, and the number of inwardly extending members. The pressure change frequencies can be tuned to resonate with a particular material and thereby more effectively disintegrate different materials. Hence, this type of mill may be referred to herein as a resonance disintegration (RD) mill.

According to another aspect of the invention, a method of liberating an intracellular resinous material from cells of bulk plant matter includes subjecting the bulk plant matter to rapid pressure increases and decreases, and opening walls of the cells with the pressure increases and decreases, thereby liberating the resinous material from the cells and producing a heterogenous mixture comprised of cell wall fragments and the resinous material. The method further includes placing particles of the mixture in a liquid, sedimenting particles of the resinous material in the liquid, and removing the sedimented particles of the resinous material.

The liquid may be water, an organic solvent, such as alcohol, or a mixture of water and the organic solvent. The particles placed in the liquid can be a screened fraction of the mixture. The method can also include drying the sedimented particles.

The plant matter can include pieces of *Piper methysticum* (kava), wherein the resinous material includes kava lactones.

According to yet another aspect of the invention, a method of liberating intracellular material from biological material having cell walls includes subjecting the biological material to rapid pressure increases and decreases, and exceeding the elastic limit of the cell walls with the rapid pressure increases and decreases. This thereby opens the cell walls and liberates the intracellular material. The method may further include the step of exceeding the elastic limit of intercellular bonds between the cells with the rapid pressure increases and decreases, thereby separating cells from each other.

The application of resonance disintegration to process biological materials, and in particular plant and fungal material, has several advantages over mechanical grinding or impact pulverization methods. An RD mill can be run at different speeds and can generate a wide range of different frequencies. Hence it is a versatile instrument for generating forces needed for RD. Heat generated during the rapid process of RD is modest and hence heat sensitive biological molecules are not destroyed. An RD mill can also accommodate materials that have significant water content. During milling, water is driven off resulting in a dry or dryer product.

The process product has a reduced water content. When plant or fungal material is processed, cellulose particles in the product have a generally larger size than other product materials. These properties each make the desired material easier to separate from the cellulose, for example, with an air classifier or by screening. A purer and more efficacious product is produced.

When the water content of the biological material is about 40% by weight or less, the liberated intracellular materials are in the form of a dry powder, which is easy to assimilate by ingestion. The process increases the available exposed surface of the intracellular material for more efficient extraction with aqueous or organic solvents.

The liberating process can be carried out without the use of chemicals or solvents, thereby making a more pure product and reducing the risk of chemically altering the product. Bulk materials, including pieces of plant fungal and animal matter, can be processed with an RD mill. More pure and more concentrated product of intracellular material can be produced according to these methods in a cost effective manner.

An added benefit of using an RD mill to liberate intracellular products from biological material is that it can destroy bacteria, thereby reducing the bacterial load of the processed material.

BRIEF DESCRIPTION OF THE DRAWING

The invention may be understood with reference to the following detailed description and the drawings, in which.

DETAILED DESCRIPTION OF THE INVENTION

Figure 1:
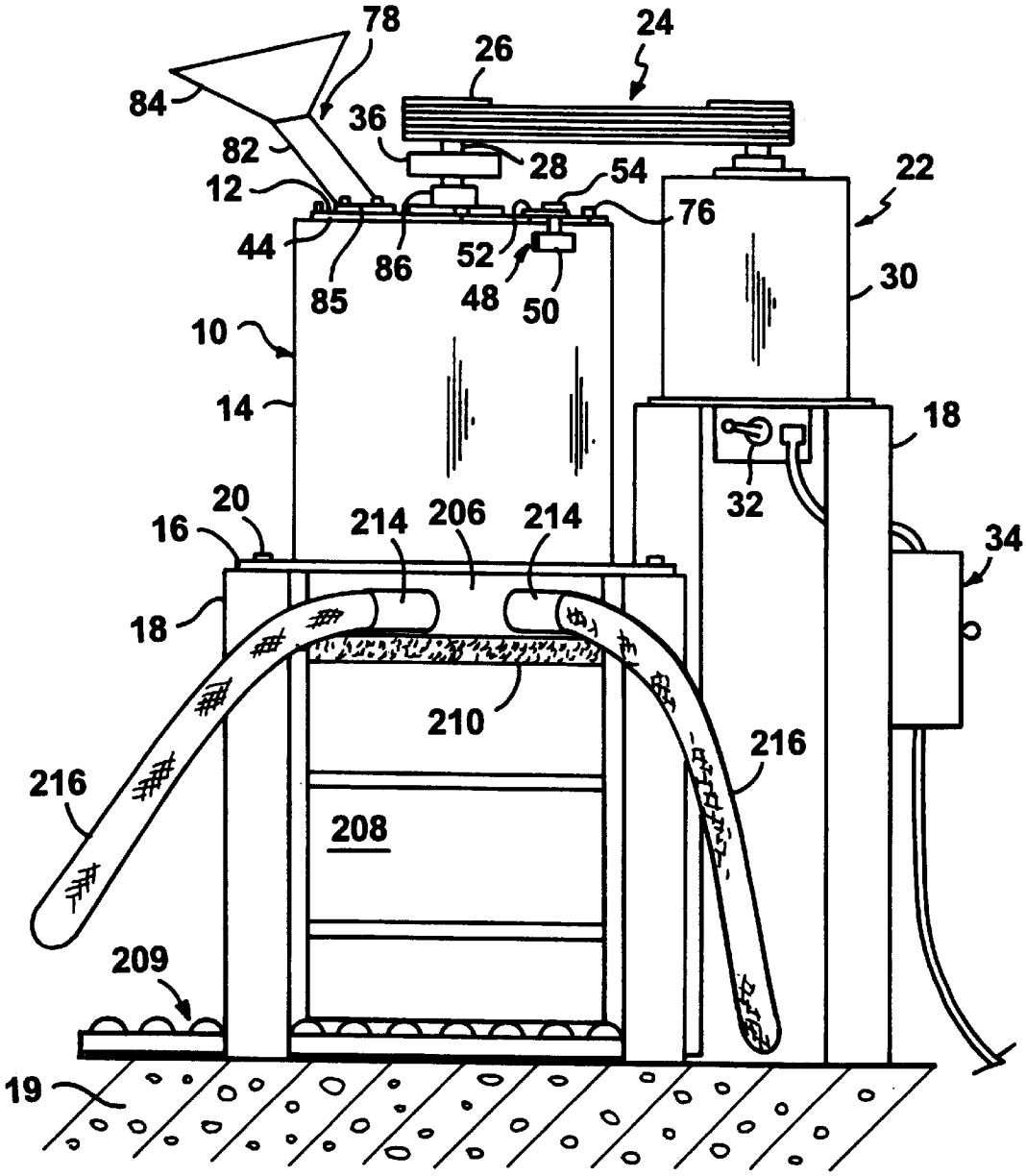
FIG. 1 is an elevation view of a milling apparatus which is used to liberate intracellular material from cells of biological material.

Intracellular material of plants, animals, fungi and bacterial, which may include proteins, enzymes, fats, amino acids, membrane-bounded materials, starch storage granules, and other types of granules, are often sought after substances of nutritional or pharmaceutical value. The cellulose walls of plant and fungal cells are composed extensively of interwoven and cross-linked strands of cellulose, which presents a substantial barrier to extraction of intracellular contents. The invention provides methods of extracting active or desired intracellular material from the cells of biological material, including from bulk pieces of plants or fungi.

Biological material, including pieces of plant, animal or fungal matter, can be processed in bulk quantities at low cost by using a resonance disintegration milling machine, or RD mill, which will be described in greater detail. An RD mill subjects the biological material to rapidly alternating increasing and decreasing pressures, which may include shock waves, at temperatures that do not change the character of the component material. In an RD mill matter is broken into smaller particles when the natural elasticity of the matter in question is exceeded by the rapid pressure changes. Certain frequencies can be generated in such a mill that will disintegrate given forms of matter. The optimal disintegration frequency will vary among different materials as different substances have different natural resonances. Resonance disintegration is not a random process, which is characteristic of impact types of pulverization. When a given set of frequencies are applied materials composed of numerous components of different elasticity are disintegrated into a broad size range of particles. It is believed that the rapid pressure changes within the mill separate individual cells of the plant and fungal matter from each other and further split, rend, tear, burst, or otherwise open and further fragment the cell walls. This liberates the intracellular material. The mill also liberates and substantially drives off water and volatile materials from the biological material. The liberated intracellular contents are more available for assimilation in the digestive tract.

An RD mill produces a substantially powdered product having a reduced water and volatile component content. When pieces of plant or fungal material are processed, the particles are of various sizes as the natural elasticity of different plant or fungal structures is not the same. Cellulose particles in the product tend to be relatively larger than other particles of material liberated from within the cells. We have also observed, in some cases, that intracellular materials are processed by the mill into size ranges that differ for different materials. The resulting product is a dry heterogenous mixture, including large cellulose and woody fragments and smaller fragments of intracellular material.

Particles of different sizes and density can be separated in some instances using common dry particle fractionation or screening methods. Some other materials from within some cells may be separated from the heterogenous product by water or organic solvent extraction, sedimentation or a combination of such processes. The greater the surface area of a particle relative to its mass, the greater the rate of solubilization and extraction. RD processing of plant materials fragments cells and provides fine particles that can be more readily solubilized.

Large, polymeric molecules are often packaged together and stored within plant and animal cells. An RD mill can liberate these large molecules and further break up large clusters of the molecules without causing large scale damage to the individual molecules. This is possible because RD can be performed under force levels that discriminate between strong co-valent chemical bonds and weaker intermolecular forces that bind molecules together to form clusters or crystals of various sizes.

The process applies to virtually all biological materials composed of cells, including herbal, medicinal and food plants and fungi. Any part of a plant can be processed, including, leaves, stems, roots, bark, and seeds. Fungal matter, such as mushrooms, can be processed in whole or in part.

Herbals that can be processed accordingly to liberate intracellular materials include, without limitation: Alfalfa (*Medicago sativa*); almonds (*Prunus amygdalus*); aloe vera (*Aloe barbodenis*, several strains and related species); angelica (*Angelica archangelica*); anise (*Pimpinella anisum*); arnica (*Arnica montana*); artichoke (*Cynara scalymus*); astragalus (*Astragalus membranaceous*); basil (*Ocimum basilicum*); bayberry bark (*Myrica certifera*); bilberry (*Vaccinium myrtillus*), black cohosh (*Cimicifuga racemosa*); black walnut (*Juglans nigra*); blessed thistle (*Cnisus benedictus*); boneset (*Eupatrorium perfoliatum*); borage (*Borago officinalis*); buchu (*Barosma betulina*); burdock (*Arctium lappa*); butcher broom (*Ruscus acluteatus*); calendula (*Calendula officinalis*); cardamon (*Elletaria cardamonuum*); cayenne (*Capsicum frutenscens*); caraway (*Carum carui*); catnip (*Nepeta cataria*); chamomile (*Matricaria chamomilla*); chaparral (*Larrea tridentata*); chaste tree (Verbenaceae); chickweed (*Stellaria media*); chives (*Allium schoenoprasum*); cloves (*Caryophyllum aromaticus*); comfrey (*Symphytum officinale*); cranberry (*Vaccinium macrocarpon*); damiana (*Turnea aphrodisiaca*); devil's claw (*Harpagophytum procumbens*); dill (*Anethum graveolens*); dong quai (*Angelica sinensis*); echinacea (*Echinacea angustifolia*); ephedra (*Ephedra sinica*); eucalyptus (*Eucalyptus globulus*); evening primrose (*Oenothera biennis*); eyebright (*Euphrasin officinalis*); fennel (*Foeniculum vulgare*); fenugreek (*Trigonella graecum*); feverfew (*Chrysanthemum parthenium*); Fo-Ti (*Polygonum multiforum*); garlic (*Allium salivum*); ginger (*Zangiber officinale*); ginko (*Ginkgo biloba*); ginseng (*Panox ginseng, Panax quinquefolius*); golden seal (*Hydroastis canadensis*); gotu kola (*Centella asiatica*); hawthorne berry (*Crataegus oxyacantha*); hops (Humulus lupulus); horse chestnut (*Aesculus hippocastum*); horse tail (*Equisetum arvense*); jasmine (*Jasminum officinale*); juniper berry (*Junipera communis*); kava (*Piper methysticum*); lady's mantle (*Alchemilla vulgaris*); lavender (*Lavendula officinalis*); lemon balm (*Melissa officinalis*); licorice (*Glycyrrhiza globra*); marshmallow (*Althea officinalis*); marijuana (*Cannibis marijuana*); meadow sweet (*Filipenda ulmaria*); milk thistle (*Cardus marianus*); mullein (*Verbascum thapsus*); mustard (*Brassica hirta*); myrrh (*Commiphora myrrha*); nettle (*Urtica dioicu*); noni (*Indian mulberry*) (*Morinda citrifolia*); oat fiber (*Avena sativa*); olive (*Olea europaea*); onion (*Allim cepa*); oregon grape (*Mahonia aquifolium*); osha (*Ligusticum porteri*); papaya (*Carica papaya*); parsley (*Petroselinum sativum*); passion flower (*Passiflora incarnata*); pennyroyal (*Hedeoma pulegioides*); peppermint (*Mentha piprita*); pleurisy root (*Asclepias tuberosa*); psyllium (*Plantago psyllium*); raspberry leaves (*Rubus idoeus*); red clover (*Trifolium pratense*); rosemary (*Rosmarinus officinalis*); sage (*Salvia offininalis*); St. John's wort (*Hypericum perforatum*); sarsoparilla (*Similax officinalsis*); saw palmetto (*Serenosa serrulata*); shiitake mushroom (*Lentinus edodes*); skull cap (*Scutellaria lateriflora*); suma (*Pfaffia paniculats*); thyme (*Thymus vulgaris*); tumeric (*Circuma longa*); uva ursi (*Arctoslaphylos uva ursi*); valerian (*Valeriana officinalis*); white willow bark (*Salix alba*); witch hazel (*Hamamelis virginiana*); yerba santo (*Eriodictyon californicum*); and yucca (*Yucca liliaceae*).

Common foodstuffs and agricultural products that also can be processed by an RD mill to liberate intracellular material include: cereal grains, such as wheat, oats, barley, corn, and rice; sorghum; flax; legumes; wheat grass; celery; carrot; parsnips; potato; broccoli; peppers; tea; coffee bean; yeast; fungi; and soybean.

In the following sections, an RD mill apparatus will be described first. Methods of using the RD mill to liberate intracellular material from biological material, such as bulk pieces of plants and fungi, will be described next, with examples.

RD Mill Apparatus

An RD mill apparatus is described in U.S. patent application Ser. No. 09/290,484, filed Apr. 12, 1999, to Charles A. Arnold, the entire disclosure of which is included herein by reference. Mills of this type include a plurality of rotors arranged alternatingly with orifice plates within a multi-sided housing. The rotors each have vanes on a side of a polygonal-shaped rotor plate. The orifice plates each have a central opening that is smaller than the nearest rotor plates. Members, such as vertical posts or pin members, extend inward from corners of the housing opposite the rotors. Biological material, such as pieces of plants or fungi, which are introduced into the housing above the top-most rotor become entrained in a Coanda flow such that the material passes around each rotor and through each orifice substantially without high angle impacts on the rotors, the orifice plates or the housing. The rotors, the orifice plates, the walls of the housing, and pins are arranged such that the flowing material is subjected to a series of rapid pressure changes which break up the material into smaller pieces.

Figure 2:
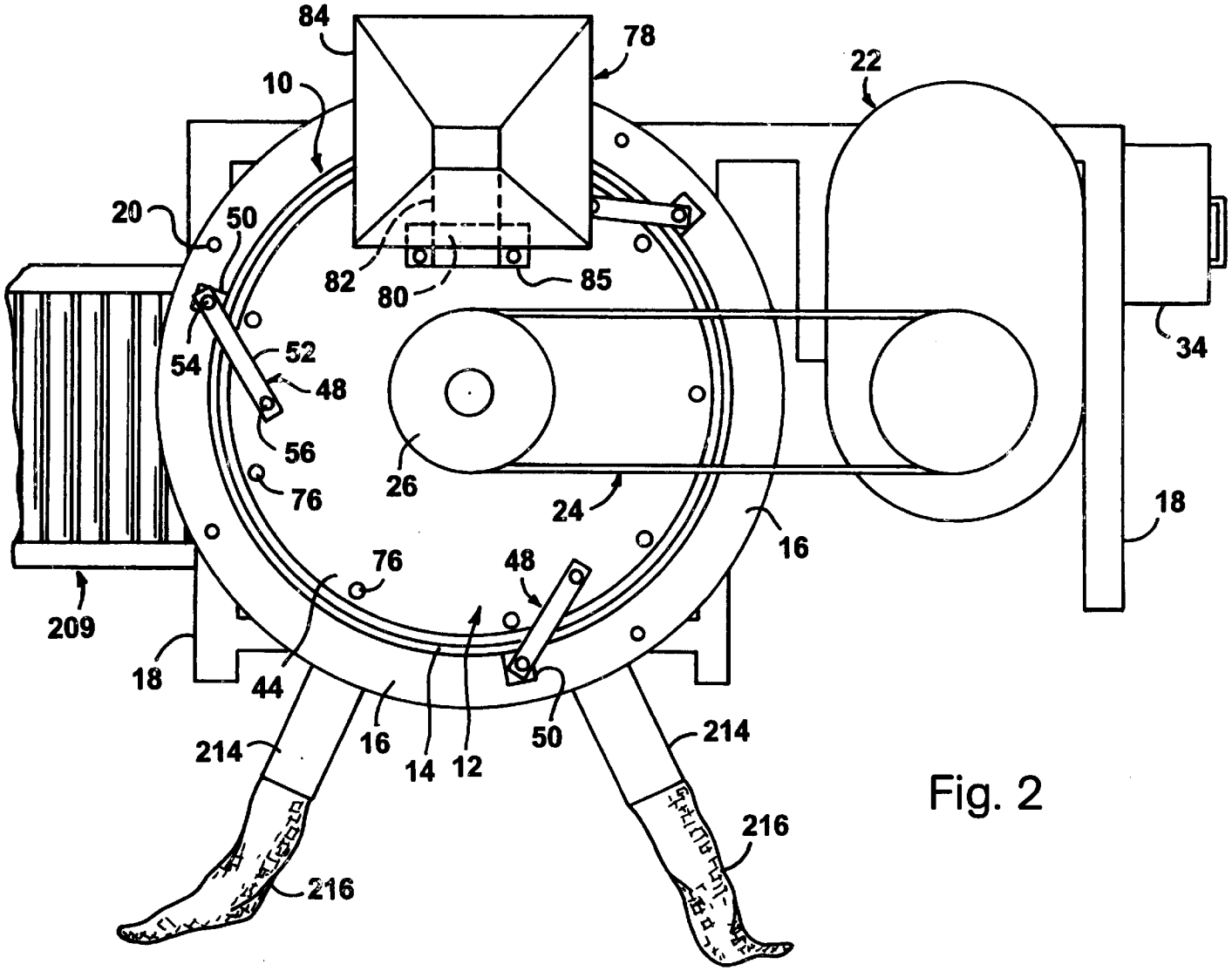
FIG. 2 is a top plan view of the mill illustrated in FIG. 1.

Referring to FIGS. 1 and 2, an RD mill 10 includes a housing 12 containing a rotor assembly 38, which will be described in detail below. Housing 12 is surrounded by a cylindrical shield 14 that is supported from an annular plate 16 by a free-standing support frame 18 on a concrete slab 19. Annular plate 16 is welded to shield 14 and secured to frame 18 with bolts 20.

Frame 18 also supports a motor assembly 22, which provides rotational power to the rotor assembly via a single four-grooved belt 24 coupling to a variable mechanical sheave 26. Sheave 26 is connected to a rotor shaft 28 that extends through housing 12. Rotor shaft 28 is fabricated from 2 inch diameter, 4140 steel rod. In the described embodiment motor assembly 22 includes a 25 hp, 230 V, three phase motor 30 that has a variable speed control 32. Motor assembly 22 receives power from a fusible disconnect 34. The variable mechanical sheave and control 32 permit the speed of rotor shaft 28 to be continuously varied between about 600–3800 revolutions per minute (rpm). A sprocket assembly 36 attached to shaft 28 is used to measure the actual rotational speed of shaft 28. A shroud (not shown) can be used to cover belt assembly 24.

Figure 3:
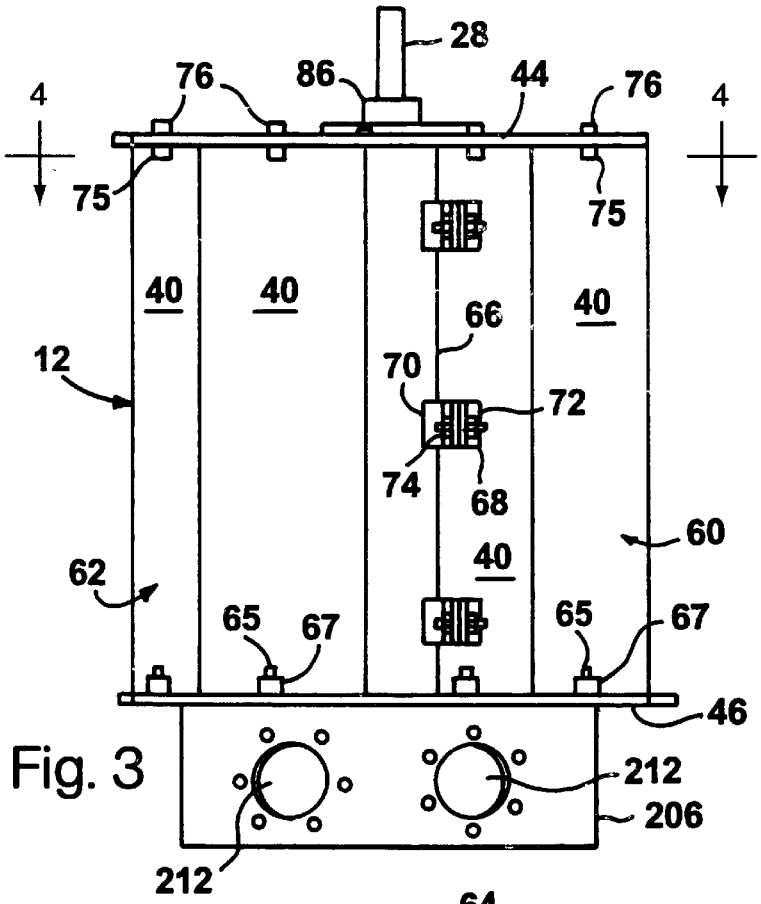
FIG. 3 is an elevation view of a rotor assembly housing of the mill illustrated in FIG. 1.
Figure 4:
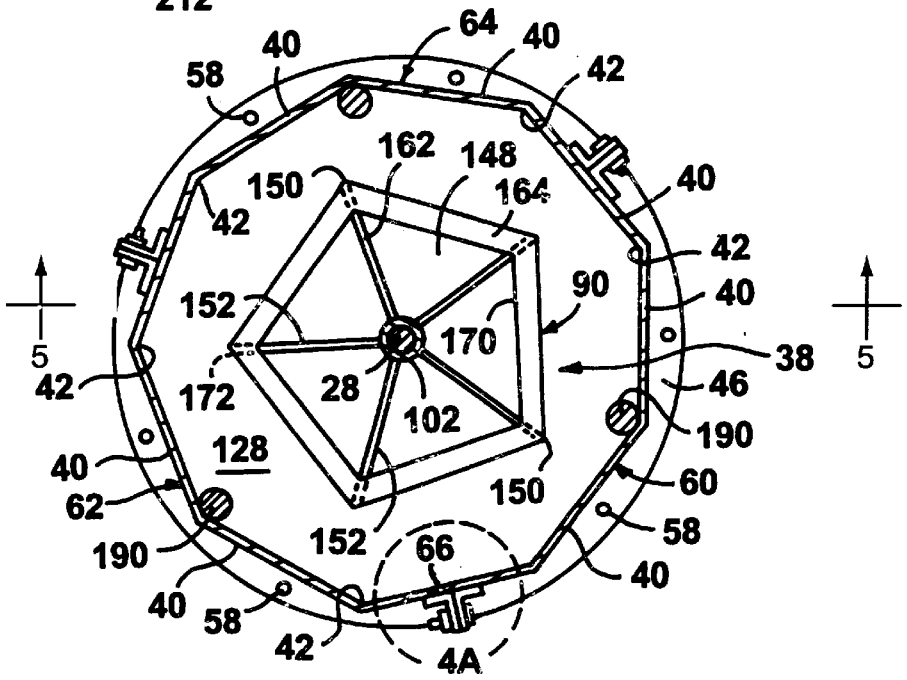
FIG. 4 is a cross sectional view through line 4—4 of FIG. 3, and in which a distributor rotor is shown in plan view.

Referring now also to FIGS. 3 and 4, housing 12 has nine longitudinally extending side walls 40 forming a regular polygon shape in latitudinal cross section. The interior surface of housing 12 has an inscribed diameter of approximately 23.5 inches. Sides 40 form 40° apices, or interior corners 42, where they meet. Sides 40 and interior corners 42 extend longitudinally between a top plate 44 and a bottom plate 46. Top and bottom plates 44, 46 are approximately 30.5 inches apart. Top plate 44 is rigidly tied to shield 14 with three strap assemblies 48 (FIGS. 1 and 2). Strap assemblies 48 each include a bracket 50 welded to the outer surface of shield 14, a rigid strap 52, and bolts 54, 56 connecting strap 52 to bracket 50 and top plate 44, respectively.

Figure 4A:
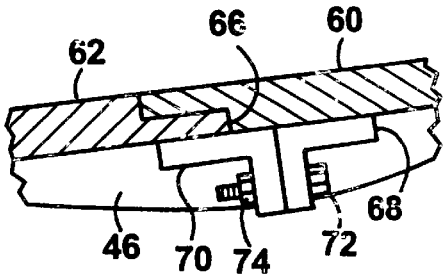
FIG. 4A is a detail of FIG. 4.

Sides 40 are formed of three panels 60, 62, 64, each including two full sides 40 and two partial sides 40, and three interior corners 42. Referring now also to FIG. 4A, each pair of panels, e.g., 60 and 62, is joined with an overlapping seam 66 located about midway between corners 42. Brackets 68 are welded to panel 60, and brackets 70 are welded to panel 62 adjacent to seam 66. Bracket pairs 68, 70 are tied together with bolts 72 and nuts 74. A silicon based sealant is used at seam 66 and other joints between pieces of housing 12 to make housing approximately air-tight.

Referring again to FIGS. 2 and 3, bottom plate 46 is supported from a portion of annular plate 16 that extends radially inward a short distance from shield 14. A gasket (not shown) providing a liquid tight seal is placed between annular plate 16 and bottom plate 46. A J-bolt arrangement (not shown) is employed for ensuring a positive seal with the gasket. Bottom plate 46 is secured to panels 60, 62, 64 with nine threaded fasteners 65 that extend through apertures formed in respective fittings 67 attached to panels 60, 62, 64, and that screw into threaded holes 58 arrayed around the periphery of bottom plate 46. Top plate 44 is bolted to threaded fittings 75 on panels 60, 62, 64 with threaded fasteners 76.

A feed chute 78 for introducing material to be pulverized into housing 12 extends through an aperture 80 in top plate 44. For clarity of illustration, feed chute 78 is illustrated at a position in FIG. 2 that is different from the position depicted in FIG. 1. Feed chute 78 includes a rectangular shaped tube 82 that is oriented relative to the plane of top plate 44 at an angle of approximately 44 degrees. Feed chute 78 also has a funnel 84 at its top end and a bracket 86 for attachment to top plate 44. Tube 82 is approximately 13.25 inches long, extends approximately 1.375 inches below the bottom side of top plate 44, and has interior dimensions of 3×4 inches. Tube 82 includes a flange 85 for attaching feed chute 78 to top plate 44, e.g., with threaded fasteners.

The rotor assembly 38 will now be described in detail with reference to FIGS. 1 and 4–6. Rotor assembly 38 includes a rotatable shaft 28 that extends longitudinally through housing 12. Shaft 28 extends through a top bearing assembly 86 that is bolted to top plate 44. Sprocket speed indicator assembly 36 and sheave 26 are positioned on shaft 28 above top bearing assembly 86. A bottom bearing assembly 88 is bolted to the bottom side of bottom plate 46. Shaft does not extend through bottom bearing assembly 88.

Within housing 12, there are six longitudinally spaced rotors 90, 92, 94, 96, 98, 100, each being fixed to a respective hub 102, 104, 106, 108, 110, 112 that is coupled to shaft 28 by two keys (not shown). Spacers 114, 116, 118, 120, 122, which are also keyed onto shaft 28, are positioned between adjacent pairs of hubs 102, 104, 106, 108, 110, 112. Spacers 124 and 126 are positioned adjacent top plate 44 and bottom plate 46, respectively. Spacer 124 is also secured to shaft 28 with a set screw (not shown). Shaft 28 can be fabricated is made of 2 inch diameter 4140 alloy steel. The diameter of each spacer is approximately 3.5 inches. The longitudinal position of one or more than one of rotors 90, 92, 94, 96, 98, 100 can be adjusted by changing the length one or more of spacers 114, 116, 118, 120, 122, 126.

Orifice plates 128, 130, 132, 134 and 136 are positioned between adjacent pairs of rotors 90, 92, 94, 96, 98 and 100. Orifice plates 128, 130, 132, 134, 136 each extend to housing sides 40 such that there is no gap between the edge of an orifice plate and the housing sides 40. A gasket or other sealing means can be used to assure that there is no space between orifice plates 128, 130, 132, 134, 136 and housing sides 40. Each of orifice plates 128, 130, 132, 134, 136 includes a central aperture, which, with its respective spacer 114, 116, 118, 120, 122, provides an annular shaped orifice 138, 140, 142, 144, 146 therebetween.

In the described embodiment, each of shield 14, annular plate 16, top plate 44, bottom plate 46, panels 60, 62, 64, rotors 90, 92, 94, 96, 98, 100, and orifice plates 128, 130, 132, 134, 136 are fabricated of 0.5 inch thick low-carbon steel, such as, for example, 1020 steel.

Figure 7:
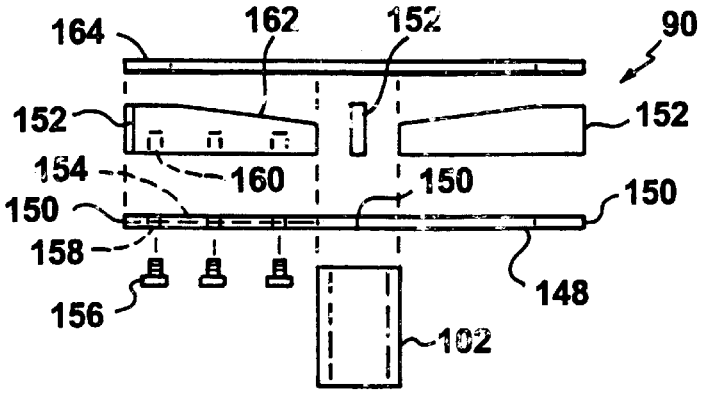
FIG. 7 is an expanded view of the distributor rotor.

Referring now also to FIG. 7, the topmost rotor 90, which will also be referred to as a distributor rotor, is positioned closest to where material is fed into housing 12 via feed chute 78. Distributor rotor 90 includes a distributor rotor plate 148 having a regular pentagonal-shaped peripheral edge forming five apices, or outside corners 150. Five distributor rotor vanes 152 extend upwards toward top plate 44 from the top side of distributor rotor plate 148 (only three vanes are shown in FIG. 7 for clarity). Each distributor rotor vane 152 also extends approximately radially inward from an outside corner 150 to hub 102. Vanes 152 can be fixed to distributor rotor plate 148 and hub 102 by welding. Alternatively, each distributor rotor vane 152 can fit into a corresponding slot 154 formed in distributor rotor plate 90, and secured by threaded fasteners 156 that extend through apertures 158 in distributor rotor plate 90 and screw into corresponding threaded holes 160 in distributor rotor vane 152. An upper edge 162 of each distributor rotor vane 152 is sloped upwards from an elevation of about 1 inch at 102 to an elevation of about 1.5 inches near the periphery of plate 148. A pentagon-shaped distributor ring 164, which is about 1.5 inches wide, is welded to the upper edges 162 of distributor rotor vanes 152.

Each of distributor rotor plate 148, distributor ring 164, and distributor rotor vanes 152 are fabricated from 0.5 inch low-carbon steel plate. Distributor rotor is circumscribed by a 17 inch diameter circle and is approximately 2.7 inches high. Distributor ring 164 is located approximately 1.625 inches below top plate 44 and approximately 0.25 inches below a discharge opening 166 of feed chute 78. Discharge opening 166 of feed chute 78 is positioned such that when a center of a chord of distributor ring 164 is aligned with discharge opening 166, a radially innermost edge 168 of discharge opening 166 extends about 0.5 inches inwardly beyond an inner edge 170 of distributor ring 164. When a corner 150 of distributor rotor 90 is aligned with feed chute 78, the outside of discharge opening 166 is completely inside distributor ring 164. This provides a large area to feed material into slots between distributor rotor vanes 152, and discharges the material from feed chute 78 onto rotor 90 as radially distant from hub 102 as possible. For reasons that will be discussed below, each vane 152 is positioned such that when rotor assembly is spinning, a trailing outer edge 172 of each distributor rotor vane 152 is shaped to be about aligned with the peripheral edge of distributor rotor plate 148 at a trailing edge of an apex 150, either without any overlap or with distributor rotor vanes 152 extending slightly over the edge of distributor rotor plate 148.

Figure 8:
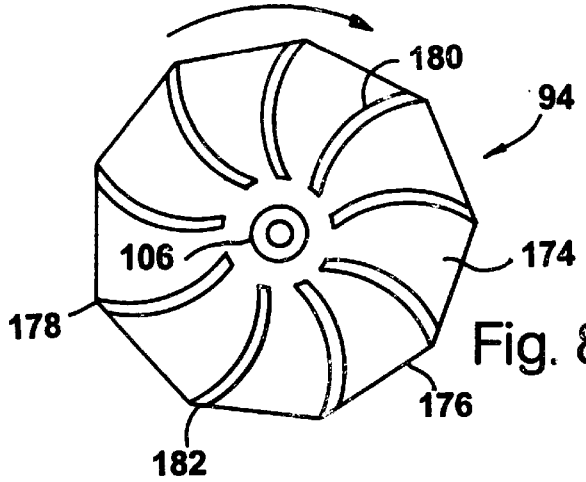
FIG. 8 is a top plan view of an orifice plate of the rotor assembly.

Other rotors 92, 94, 96, 98, 100 are designed differently from distributor rotor 90, but similarly to each other. Rotor 94 will be described as an example, with reference to FIG. 8. Rotor 94 includes a rotor plate 174 having a regular nine-sided polygonal peripheral edge 176 forming nine apical corners 178. Rotor plate 174 is welded or otherwise rigidly coupled to hub 106. Rotor 94 also includes nine curved vanes 180, each extending approximately radially inward toward hub 106 from a respective one of the apical corners 178. Vanes 180 are approximately six inches long and extend approximately one inch above rotor plate 174, which is about 0.5 inches thick. For most uses of mill 10, the interior curve of each of vanes 180 faces into the direction in which rotor assembly turns. Rotor plate 174 is fabricated from 0.5 inch low-carbon steel plate, and vanes 180 are fabricated from 0.5 inch wall, 8 inch outer diameter steel tubing. Vanes 180 are set in respective 0.125 inch deep grooves (not shown) formed on an upper face of rotor plate 174, and secured in place with three threaded fasteners (not shown) that extend through apertures (not shown) formed in rotor plate 174, in a manner similar to that described above with reference to distributor rotor 90 illustrated in FIG. 7. This arrangement permits simple removal and replacement of vanes 180. Outer trailing edges 182 of vanes 180 are beveled at an angle to align with peripheral edge 176 of rotor plate 174 and such that trailing edge 182 extends slightly over edge 176 of rotor plate 174 on the trailing side of an apical corner 178.

The other rotors, rotors 92, 96, 98 and 100, are configured similarly to rotor 94, each having a nine-sided peripheral edge 176 and curved vanes 180 extend radially inward from apical corners 178 toward respective hubs 104, 108, 110 and 112. In the embodiment illustrated in FIG. 5, rotors 92, 94, 96, 98 and 100 are circumscribed by circles having diameters of 17, 19, 21, 21, and 21 inches, respectively. Each of vanes 180 is approximately 6 inches long about its outer perimeter and shaped at its apical corner 182 so that there is a slight overlap between vane 180 and rotor plate 174 at its trailing edge 182. Each of rotors has a height of approximately 1.5 inches. Because rotor 92 is smaller than the other rotors and vanes 180 are the same size on all rotors 92, 94, 96, 96, 100, each of vanes 180 on rotor 92 extend approximately to hub 104, whereas vanes 180 on rotors 94, 96, 98, 100 do not extend all the way to hubs 106, 108, 110, 112, respectively, a gap being provided therebetween.

Figure 11:
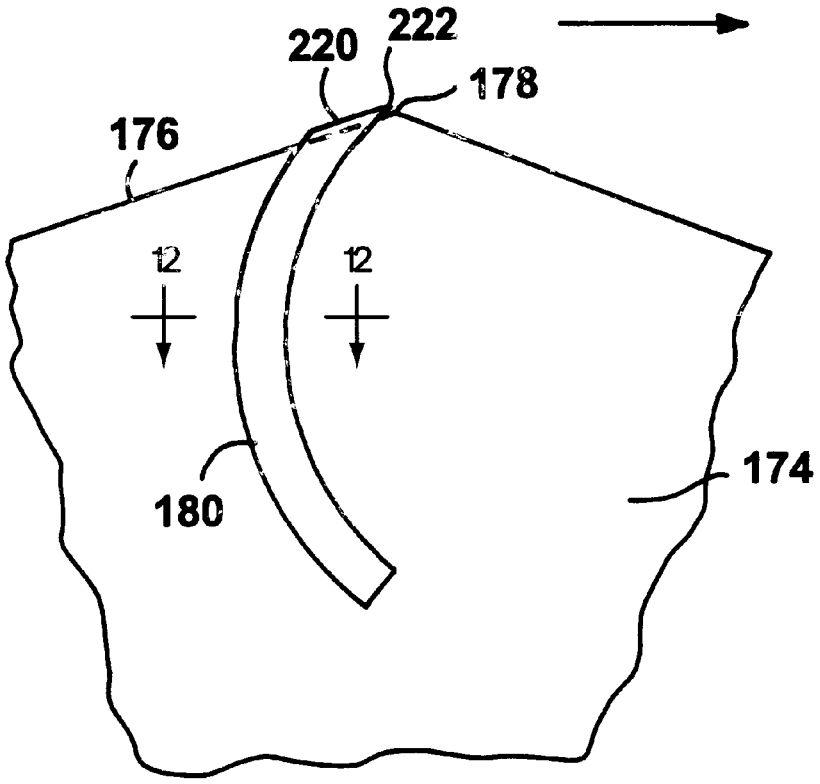
FIG. 11 is a plan view of a portion of a rotor with another embodiment of a rotor vane.

Referring now to FIG. 11, each of vanes 180 may be positioned to provide a small overhang 220 over the edge 176 of the rotor plate to which it is attached. Overhang 220 would be no more than about a thirty-second of an inch, and would enhance the flow through mill 10. Note that vane 180 illustrated in FIG. 11 is also positioned such that overhang 220 is shaped similar to edge 176 of rotor plate 174, and an outer tip 222 of its leading surface 224 is positioned about over apical corner 178. The arrow in the figure indicates a direction of rotation.

Figure 12:
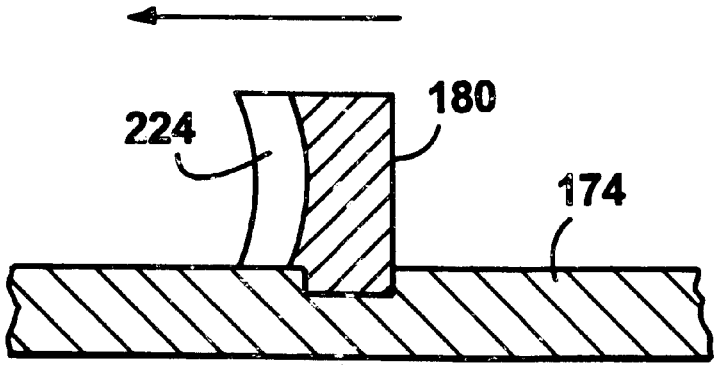
FIG. 12 is a cross sectional view through line 12—12 of FIG. 11.

Referring now to FIG. 12, vanes 180 may also be modified to have a curved profile, like a turbine blade, on its leading surface 224 with respect to a direction of rotation (arrow) to provide a more efficient pumping action.

Figure 9:
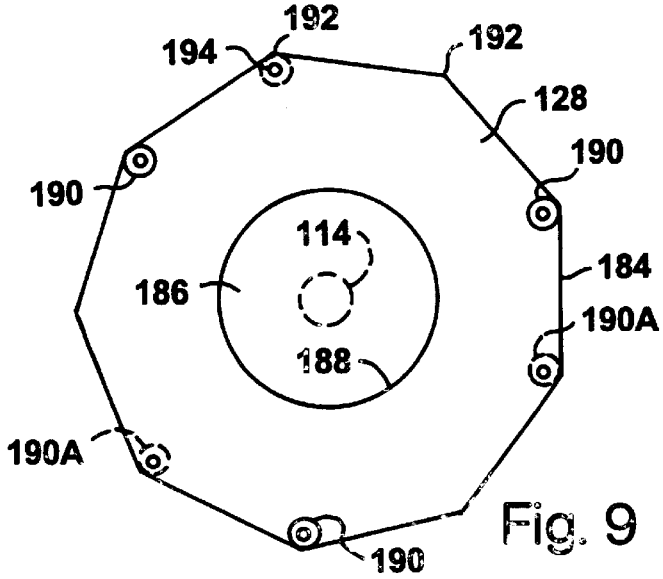
FIG. 9 is a top plan view of a rotor.

Referring now also to FIG. 9, orifice plate 128 can be fabricated from 0.5 inch low-carbon steel plate. Its peripheral edge 184 forms a nine-sided polygon sized to fit closely against sides 40 of housing 12. Orifice plate 128 includes a central aperture 186 formed by inner rim 188, which, with spacer 114, provides annular-shaped orifice 138 therebetween. Orifice plates 130, 132, 134, and 136 are similarly configured. Orifice plates 128, 130, 132, 134, and 136 have apertures 186 with diameters of 7, 8, 9, 10 and 11 inches, respectively.

Figure 5:
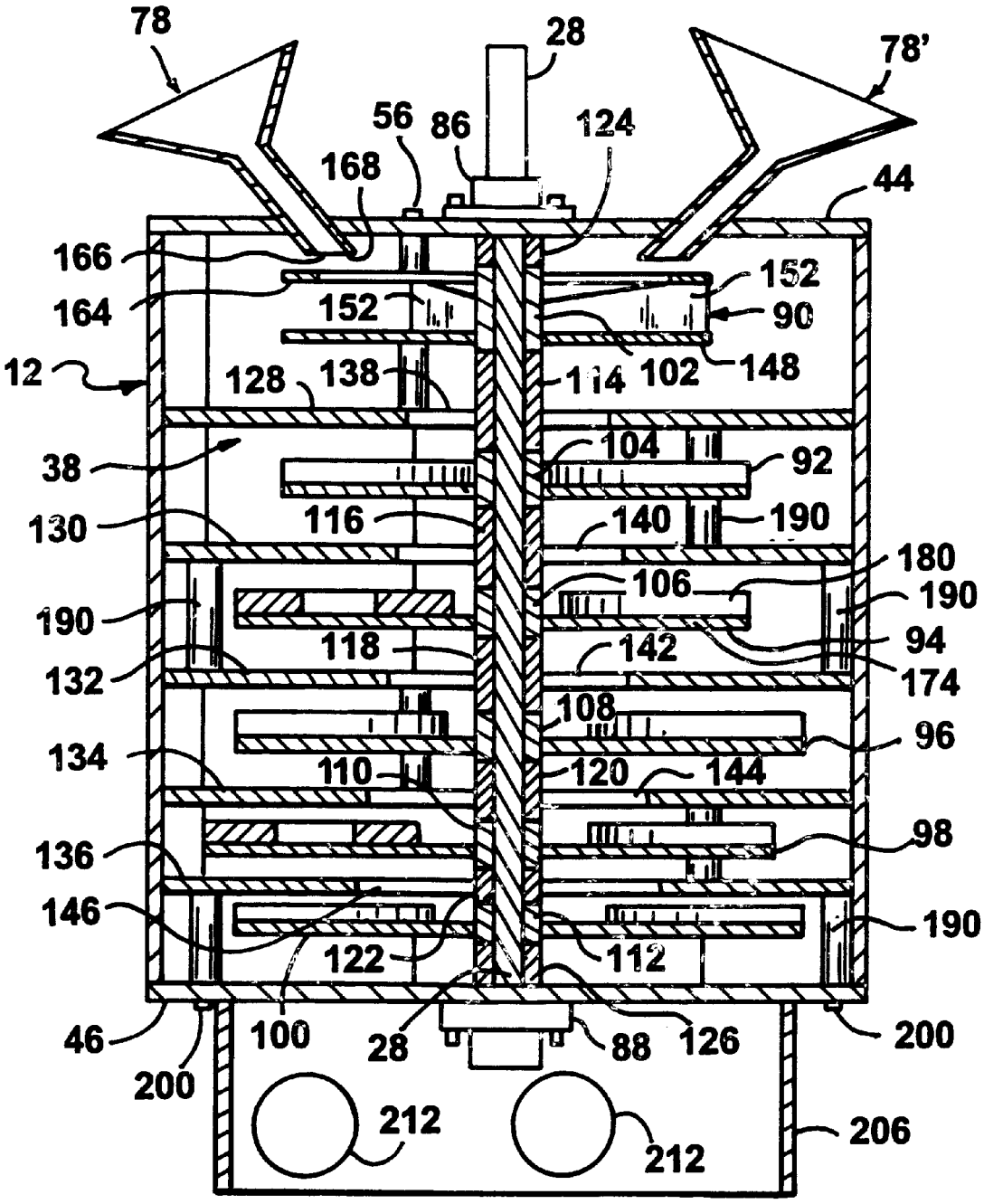
FIG. 5 is a cross sectional view through line 5—5 of FIG. 4, showing the rotor assembly within the rotor assembly housing.
Figure 10A:
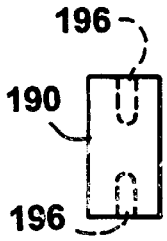
FIGS. 10A and 10B are elevation and plan views, respectively, of a rotor assembly support pin.
Figure 10B:
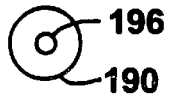
Figure 6:
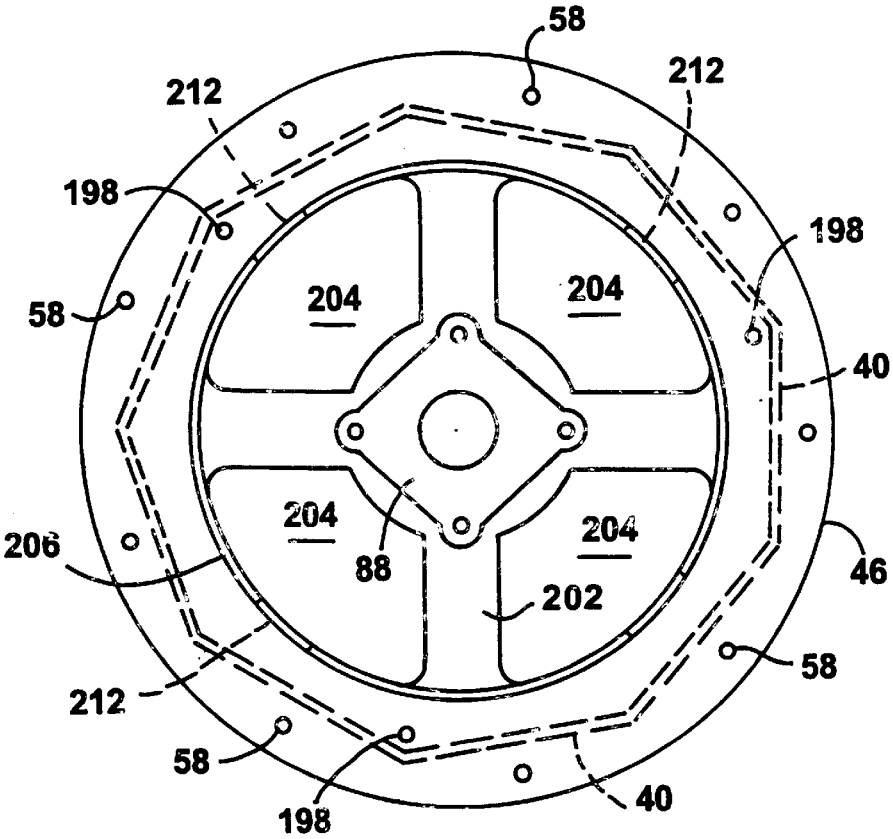
FIG. 6 is a bottom plan view of the rotor assembly housing.

Referring back to FIGS. 4 and 5, and also to FIGS. 10A and 10B, orifice plates 128, 130, 132, 134, 136 are supported independently of panels 60, 62, 64 by support pins 190. Support pins 190 can be fabricated from 2 inch diameter steel rod. Three equally spaced apart pins 190 are positioned between each neighboring pair of the orifice plates. Each support pin 190 is located at an apical corner 192 of an orifice plate so that it is adjacent an interior corner 42 of housing. As shown in FIGS. 5 and 9, support pins 190 on one side of an orifice plate, e.g. orifice plate 128, are offset by one apex (40°) from support pins 190A on the other side of that orifice plate.

Support pins 190 are attached to the orifice plates by threaded fasteners 194, e.g., bolts, that extend into countersunk through holes (not shown) formed in the orifice plates and into threaded holes 196 formed in pins 190. Three support pins 190 that are attached to an upper side of orifice plate 128 can also be attached to top plate 44 with bolts 56, which are also employed to hold straps 52 as described above with reference to FIG. 2. Three support pins 190 that are attached to a bottom side of orifice plate 136 can also be attached to bottom plate 46. Bottom plate 46 includes three apertures 198 through which threaded fasteners 200 (shown in FIG. 5) can be inserted for fastening to these three pins 190.

Referring again to FIG. 6, bottom plate 46 includes a web 202 forming four apertures 204 through which pulverized material is discharged from housing 12. A 23 inch diameter skirt 206 depends from bottom plate 46 just outside of apertures 204. Web 202 supports rotor assembly 38 from bottom bearing assembly 88, which is bolted to web 202. The size of web 202 is made as small as possible to maximize the size of apertures 204 within skirt 206.

The diameter of skirt 206 is sized to fit into a 55 gallon open barrel 208, which rests on rollers 209. A fabric belt 210 is employed between skirt 206 and barrel 208 to inhibit fine pulverized particles from escaping. Skirt 206 includes four apertures 212 (only two shown in FIG. 3). Each aperture 212 includes a bolt circle employed for attaching a respective 6 inch diameter tube 214 (only two shown in FIGS. 1 and 2). Tubes 214 extend approximately radially outward from skirt 206, and each tube 214 has a fabric filter bag 216 removably attached to it. Air is exhausted from mill 10 through tubes 214. Filter bags 216 catch fine particles and allow air to pass through. One or more of tubes 214 can be blocked off to increase the back pressure. Increasing the back pressure will result in material flowing through RD mill 10 more slowly, providing more time to break up the material.

In the described embodiment, rotors 90, 92, 94, 96, 98, 100 and orifice plates 128, 130, 132, 134, 136 are positioned as follows: The top surfaces of orifice plates 128, 130, 132, 134, and 136 are respectively located approximately 2.875, 2.125, 1.875, 1.625, and 1.375 below the bottom surfaces of respective rotors 90, 92, 94, 96, and 98. Orifice plates 128 and 130 are approximately 5 inches apart; orifice plate 130 and 132 are approximately 4.5 inches apart; orifice plates 132 and 134 are approximately 4 inches apart; and orifice plates 134 and 136 are approximately 3.5 inches apart. The tops of vanes 180 on rotors 92, 94, 96, 98 and 100 are about 1.375, 1.187, 0.875, 0.625, and 0.5 inches below respective orifice plates 128, 130, 132, 134, and 136. Rotor 100 is positioned approximately 1.75 inches above bottom plate 46. Rotors 92, 94, 96, 98 and 100 are rotated relative to their next nearest rotor by about 7.2 degrees.

It can be seen that rotors 90, 92, 94, 96, 98, 100 of rotor assembly 38 have sizes that generally increase with increasing distance from a top end of housing 12 through which material to be pulverized or otherwise processed is introduced into housing. The smallest rotors 90, 92 are located closest to top plate 44, the largest rotors 96, 98, 100 are positioned closest to bottom plate 46, and an intermediate sized rotor 94 is positioned about midway between top plate 44 and bottom plate 46. This arrangement is particularly adapted for pulverizing large size objects. If the feed material comprises smaller sized particles, on average, the rotors could be of a more uniform, larger size. In some applications, it may be advantageous to have rotors that are all the same size, or to alternate between larger and smaller rotors in some fashion.

In addition, orifices 138, 140, 142, 144, 146 are of generally increasing size with increasing distance from the top end. This arrangement is used to maintain a negative back pressure at each stage. For other applications, this arrangement could be reversed, the orifices could be a more uniform size, or the orifice sizes could be varied in a different manner from one end of housing 12 to the other.

The spacing between each orifice plate and the rotor next below it generally decreases with increasing distance from top to bottom. Moreover, the rotors and orifice plates are positioned such that the spacing between adjacent orifice plates generally decreases from top to bottom. This decreases the volume in stages between the top and bottom of rotor assembly 38.

Material flowing through an orifice in mill 10 first undergoes a velocity increase and an accompanying decrease in pressure. Then, because the available volume decreases at each succeeding stage, the material flowing through mill 10 experiences a rapid compression, which in turn can cause a rapid increase in pressure and/or temperature. The size of the orifice is increased with each succeeding stage to provide a pressure immediately downstream of an orifice that is lower than the pressure immediately upstream the orifice. This negative back pressure that is maintained across each orifice helps to maintain the flow.

As best understood at this time, material introduced into mill 10 with rotor assembly 38 spinning at speeds of approximately 1000 revolutions per minute (rpm) or greater are pulverized primarily by pressure changes, which may include shock waves, which are generated within housing 12. Observations indicate that material fed into feed chute 78, as well as air entering through feed chute 78, is accelerated rapidly and is then entrained into a fluid-like flow through the spinning rotor assembly 38. It appears that the material in the flow is almost immediately subjected to a rapid-fire succession of shock waves, which may begin to break up the feed-stock material even before it reaches the distributor rotor.

The spinning rotors 90, 92, 94, 96, 98, 100 create a very strong air flow through housing 12. It appears that material fed into mill 10 through feed chute 78 is entrained in this flow. The material apparently flows, with the air flow, through mill 10 making minimal contact with sides 40 of housing 12 or with orifice plates 128, 130, 132, 134, 136. This, it is believed, is due to the flow being influenced by the Coanda effect to closely follow the contours of the rotor peripheries 174 and orifice rims 188. For this reason, the flow of material and air through mill is called a "Coanda flow." The Coanda effect helps to reduce high-angle contacts between the flowing material and the component parts of mill 10. Distributor ring 164 acts as a shroud to enhance the Coanda effect.

The Coanda flow rapidly changes direction as it rounds the peripheral edge of each rotor and the rim of each orifice, alternating between a flow that is directed radially outward and a flow that is directed radially inward. The sizes of the orifices increase with each succeeding stage to maintain a negative back pressure throughout rotor assembly 38, which helps to keep the velocity of air and particles sufficiently high to maintain the Coanda flow.

Observations made when pulverizing harder and larger materials, such as 1 inch (2.5 cm) ceramic balls, indicate that when vanes 152, 180 are not positioned on the trailing side of apical corners 150, 178, respectively, rotor plates 148, 174 experience wear, becoming slightly rounded on the underside adjacent and downstream from where vanes 152, 180 attach. This is evidence that the material is entrained in a Coanda flow that closely follows the contour of the periphery of each rotor. The leading side of each rotor vane 152, 180, particularly in the region close to its respective rotor plate 148, 174, also indicates increasing wear with proximity to its outer edge. There is also a tendency for material to ride up the side of the vane as the material is moved radially outward by the vane. However, the wear pattern shows little scoring or pitting, which would be expected if the material was not entrained in a Coanda flow. These are the only areas of rotors at which wear has been noticed. Sides 40 and orifice plates 128, 130, 132, 134, 136 show some evidence of some large particle impacts when pulverizing ceramic balls, but no wearing pattern as observed on the rotors. It is expected that a softer and less dense material, such as pieces of plant or fungi, will experience even fewer collisions with parts of mill 10.

To enhance the Coanda effect on the material flowing past vanes 152 and 180 and around rotor plates 148, 174, outer edges of the vanes can be beveled and aligned with the peripheral edge of the respective rotor plate 150 and 174. The leading edge of each vane 152, 180 should go at least to the respective apex 150, 178 of the respective rotor plate 148, 174. Positioning vanes 152, 180 such that their outer edges are on the trailing side of apical corners 150, 178 should reduce the amount of wear.

Rapid pressure changes, such as shock waves, may be generated each time the flowing material experiences a rapid acceleration, such as when the direction of flow rapidly changes, or experiences a pressure change. Such pressure changes may generate large voltages due to piezoelectric properties of the materials, as they experience rapid compression or decompression. Some places where large accelerations may take place include at discharge opening 166 of feed chute 78, going around vanes 152, 180, going around distributor rotor plate 148 and around rotor plate peripheral edges 176, and going around rims 188 of orifices 138, 140, 142, 144, 146. Large pressure changes may take place when the flow passes through an orifice or when the flow is pumped by a rotor.

A non-uniform electromagnetic field may also be generated within housing 12 as rotor assembly 38 rotates. Rotors 90, 92, 94, 96, 98, 100, as well as housing 12 and orifice plates 128, 130, 132, 134, 136, are all made of low-carbon steel, which is ferromagnetic. The spinning rotors would create a rapidly changing, non-uniform electromagnetic field. These electromagnetic fields could enhance piezoelectric effects in the material in the Coanda flow.

Primary pulsed standing shock waves may also be produced as vanes 152, 180 on rotors 90, 92, 94, 96, 98, 100 alternately pass sides 40 and corners 42 of housing. Decompression would occur as the rotors pass each empty interior corner 42 of housing 12, and compression would occur as the vanes pass the center of each side 40. A shock wave of this type would be created every 40 degrees of rotation of a vane.

Moreover, secondary pulsed standing shock waves may be produced as vanes 152, 180 pass by support pins 190, three of which are located proximate each rotor. Vanes 180 of the largest rotors, rotors 96, 98, 100, pass within about 0.1 inches of support pins 190. These shock waves would be produced every 120 degrees of rotation of a vane on a rotor due to compression of the flow as the vane passes each of the three support pins located near the rotor. Twenty-seven shock waves are generated for each rotation of a nonagon-shaped rotor. Thus, support pins 190 are employed to support the orifice plates and also to help generate shock waves. While in the described embodiment cylindrical support pins are employed for these purposes, a different arrangement can be used to support the orifice plates, and differently shaped members can be positioned in corners 42 opposite respective rotor vanes 150, 180 for generating the secondary shock waves.

Before a biological material, such as pieces of plants or fungi, is fed into mill 10, rotor assembly 38 is brought up to an operating speed of rotation. The spinning rotors generate a large air flow with negative back pressure through feed tube 78 and down through mill 10. Thus, any material fed into feed tube 78 will be immediately drawn in and accelerated rapidly towards distributor rotor 90.

As noted above, material may be broken apart while accelerating down feed chute 78 and turning direction exiting discharge opening 166. It is believed that discharge opening 166 acts as an orifice through which air and the feed-stock material flows into the larger-volume region between top plate 44 and distributor rotor 90. The flow through this first orifice provided by discharge opening 166 can cause a pressure change, which may be accompanied by a temperature change. The pressure change, along with the rapid acceleration of the particles exiting feed tube 78, can cause a first shock compression and/or expansion and an initial breaking apart of some particles.

A feed-stock biological material, such as plant or fungal material which is pre-cut to sizes of about 2 inches or less, is quickly entrained in the Coanda flow and flows through distributor rotor 90 between distributor rotor plate 148 and distributor ring 164. When the Coanda flow passes through orifice 138, the particles experience a rapid directional change and an increase in velocity with a corresponding pressure rise. The flow is immediately compressed because the volume between orifice plate 128 and rotor 92 is smaller than the volume between rotor 90 and orifice plate 128. This can also cause a rapid increase in pressure and an accompanying temperature increase.

This process of rapid acceleration, expansion, and compression is repeated as the flow passes through each succeeding stage and rounds the rotors and orifices. These rapid variations in pressure and acceleration of the flowing material may contribute to creating shock waves which pulverize material flowing through mill 10. In addition, the rapid compressing and decompressing of material in the flow can cause a build-up of piezoelectric energy and subsequent releases in the material, which may cause the break-up of some material into smaller sized particles. It is believed that the primary and secondary pulsed shock wave fronts are reinforced by shock waves created by piezoelectric energy releases in the flow. The rapid flow of material through the non-uniform electric and magnetic fields within mill 10, which are generated by the spinning rotors, may also contribute to piezoelectric compression and decompression of material in the flow, thus also contributing to generating shock waves in the flowing material.

Mill 10 heats a material being pulverized such that virtually all free moisture is driven off. Plant or fungal material having an initial moisture content of about 40% or less before processing comes out of mill 10 warmed to a temperature above ambient temperature to a temperature that depends upon the material and the operating conditions. A cooling jacket can be utilized to help limit the temperature rise of processed mater. Electric discharges from the material and the rapid expansion then compression after the flow passes through each orifice may increase the temperature of the flowing material and drive moisture out. The piezoelectric energy releases and frictional heating of particles in the flow likely contribute to the observed general increase in temperature of the pulverized material. However, flowing only air through mill 10 also causes housing 12 to warm above ambient temperature. Therefore, some of the heating effect is also probably due to pressure changes in the flowing material and energy dissipated from shock waves. Some of the heat may be carried away by vaporizing water and other volatiles.

An added benefit of using RD mill 10 to liberate intracellular products from biological material is that it reduces the bacterial load of the processed material.

EXAMPLE 1

*Piper methysticum* (kava) is a cultivated plant, derived from wild species, which contains kava lactones. These lactones dull pain and have a relaxing, tranquilizing effect on the user. The kava lactones are stored in a resinous form in the roots and stems of the plant.

Dry, crudely chopped roots and stems were processed by single or double passages through RD mill 10. The rotors were turned at a rate of 3200 rpm. A single passage yielded a fine powder, plus larger, woody particles visible to the naked eye. Particles of three distinct size ranges are produced when kava plants are processed by an RD mill. The largest particles are cellulose, the middle size particles are resinous granules of kava lactones, and the smallest size particles include other material liberated from the cells.

Upon microscopic examination of the RD processed kava, particles of assorted sizes ranging from about 10 micrometers to over 100 micrometers were observed. Intact cells were absent except for their apparent presence in woody fragments. The RD processed kava was screened under vacuum and various particle size fractions were recovered. Assays for kava lactone content were performed. Kava lactones (six different chemical species) were found to compose 9.91% of the dry weight of the whole kava root that was processed by RD mill 10. Microscopic examination revealed numerous granules of fairly uniform size. These granules were retained by a 270 mesh screen.

The +270 mesh screened powder was placed in a 50% alcohol in water mixture. Denser particles sedimented quickly under unit gravity and formed a brownish sludge at the bottom of the container. More slowly sedimenting particles formed a yellowish white layer on top of the brownish layer within about 5 minutes. This slow sedimenting material contained 67.25% kava lactone by dry weight.

Processed kava that passed through 270 mesh screen was found to contain only 2.42% kava lactone by dry weight. Therefore processing with RD mill 10 yielded particles that are slow sedimenting and larger than 270 mesh which contain the bulk of the kava lactone present in the kava root. Processing kava with RD mill 10 apparently opens and fragments cell walls of the kava plant, thereby releasing kava lactones as small resinous particles.

Kava processed according to the described method produced a kava product having a significantly greater percentage concentration of kava lactone than can be obtained by grinding or any other known economically viable method. The kava product produced by RD mill 10 is essentially free of cellulose. It therefore has a greater purity than ground kava, which typically has a high percentage by weight of other cellular material, including cellulose. In addition, the kava lactones in the product processed by RD mill 10 are more efficacious because the kava lactones are substantially all liberated from cells. In contrast, much of the kava lactones in a ground kava product is still bound within intact or only partially broken cells, and so is not freely available.

The described process for liberating and concentrating kava lactones can also be used for liberating and concentrating other types of resinous materials from other plant species.

EXAMPLE 2

*Morinda citrifolia*, commonly known as noni or Indian mulberry, is a medicinal plant with several purported and demonstrated uses: antibacterial, laxative, hypotensive, anti-inflammatory, and immunostimulant. Dried, crudely chopped noni fruit or fruit containing up to 30% water by weight was fed into RD mill 10, which was operating at 2950 rpm. A single passage through RD mill 10 yielded a heterogeneous product composed of visible (about 0.5–1.0 mm) particles to microscopic particles (about 5–30 micrometers in diameter). Many of the smallest particles clustered together to form aggregates of various sizes. Noni with about 30% water content emerged from the machine as a dry, heterogenous mixture ranging from granular to fine powder.

When the processed material was extracted with water at 80° C., about 50% by weight of the starting material was recovered as water soluble/suspended fraction.

Other embodiments and variations are within the scope of the invention, which should be determined by the appended claims and their legal equivalents, rather than only by the examples and specific embodiments described herein.

What is claimed is:

1. A method of liberating intracellular material from biological material having cells with cell walls, the method comprising:

flowing the biological material through a housing while subjecting the biological material to rapid pressure increases and decreases within the housing; and opening the cell walls with the pressure increases and decreases, thereby liberating the intracellular material from the cells and producing a heterogeneous mixture comprised of cell wall fragments and the intracellular material.

2. The method of claim 1, wherein the biological material includes at least one of plant or fungal material, and wherein the cell walls are formed of cellulose.

3. The method of claim 1, wherein the bioloigical material includes pieces of plant, fungal, or animal material.

4. The method of claim 3, further comprising separating the cells of the biological material from each other with the pressure increases and decreases.

5. The method of claim 1, further comprising vaporizing water liberated from the cells with the pressure increases and decreases, such that the mixture has a lower water content than the biological material.

6. The method of claim 1, further comprising vaporizing volatile compounds liberated from the cells with the pressure increases and decreases, such that the mixture has a lower volatile compound content than the initial volatile compound content of the biological material.

7. The method of claim 1, wherein the housing is characterized by a first end including an input adapted to introduce the biological material into the housing, a second end including an output adapted to remove the mixture, and longitudinally extending internal sides that form longitudinally extending interior corners where they meet, and wherein flowing the biological material includes rotating a rotor assembly within the housing that is characterized by a rotatable shaft extending longitudinally through the housing between the first and second ends, and a plurality of rotors coupled to the shaft for rotation therewith, wherein rotors of the plurality of rotors each comprise a rotor plate having a peripheral edge forming a plurality of apices, and vanes on a side of the rotor plate each extend approximately radially from an apex, wherein an orifice plate is positioned between adjacently located pairs of the plurality of rotors, each orifice plate extending inwardly from the internal sides of the housing to a central aperture which provides an orifice around the shaft, each of the central apertures being smaller than rotor plates of the corresponding pair of rotors, and wherein applying the alternatingly increasing and decreasing pressure to the flowing biological material includes causing the biological material to flow in an alternating outward and inward flow around preipheral edges of the rotor plates and through the orifices.

8. The method of claim 7, wherein the rotors are angularly offset from each other.

9. The method of claim 8, wherein subjecting the biological material to the rapid pressure increases and decreases further includes rotating the vanes of the rotors closely past circumferentially spaced members located proximate each of the rotors, wherein the members extend inwardly from the corners of the housing toward the rotors.

10. The method of claim 9, wherein flowing the biological material includes flowing the biological material in a Coanda flow substantially without high angle impacts on the rotor assembly, the orifice plates, or the interior sides of the,housing.

11. The method of claim 1, wherein the cell walls are formed primarily of cellulose, and further comprising exceeding the elastic limit of the cell walls with the rapid pressure increases and decreases, thereby opening the cell walls while liberating the intracellular material.

12. The method of claim 11, further comprising exceeding the elastic limit of intercellular bonds between the cells with the rapid pressure increases and decreases, thereby separating cells from each other.

13. The method of claim 1, wherein the biological material has an initial water content of about 40% or less.

14. A method of liberating an intracellular resinous material from cells of bulk plant matter, the method comprising:

subjecting the bulk plant matter to rapid pressure increases and decreases;

opening walls of the cells with the pressure increases and decreases, thereby liberating the resinous material from the cells and producing a heterogenous mixture comprised of cell wall fragments and the resinous material;

placing particles of the mixture in a liquid;

sedimenting particles of the resinous material in the liquid; and removing the sedimented particles of the resinous material.

15. The method of claim 14, wherein the liquid comprises water.

16. The method of claim 15, wherein the liquid further comprises an organic solvent.

17. The method of claim 14, wherein the particles placed in the liquid are a screened fraction of the mixture.

18. The method of claim 14, further comprising drying the sedimented particles.

19. The method of claim 14, wherein the plant matter comprises pieces of *Piper methysticum* (kava), and the resinous material comprises kava lactones.

20. The method of claim 14, wherein the bulk plant matter includes at least one of chopped roots and chopped stems.

21. A method of reducing the particle size of biological material having cells with cell walls, the method comprising:

entraining the biological material in a flow of a gas through a housing;

subjecting the biological material to a plurality of pressure increases and decreases while entrained in the flow within the housing; and breaking up the biological material with the pressure increases and decreases within the housing, thereby reducing the particle size of the biological material.

22. The method of claim 21, wherein the pressure increases and decreases open cell walls to liberate intracellular material from the cells of the biological material.

23. The method of claim 21, wherein the pressure increases and decreases separate cells of the biological material from each other to liberate intercellular components of the biological material.

24. The method of claim 23, wherein the biological material includes plant matter and the intercellular components include cellulose.

25. The method of claim 21, wherein the pressure increases and decreases separate cells from each other.

26. The method of claim 21, wherein the biological material has an initial water content of about 40% or less.

27. The method of claim 21, wherein the biological material includes pieces of plant, fungal, or animal material.

28. The method of claim 21, wherein the biological material includes an herbal biological material.

29. The method of claim 21, wherein the biological material includes a cereal grain.

30. The method of claim 21, wherein the biological material includes a member of the group consisting of: alfalfa, almonds, aloe vera, angelica, anise, arnica, artichoke, astragalus, basil, bayberry, bilberry, black cohosh, black walnut, blessed thistle, boneset, borage, buchu, burdock, butcher broom, calendula, cardamom, cayenne, caraway, catnip, chamomile, chaparral, chaste tree, chickweed, chives, cloves, comfrey, cranberry, damiana, devil's claw, dill, dong quai, echinacea, ephedra, eucalyptus, evening primrose, eyebright, fennel, fenugreek, feverfew, fo-ti, garlic, ginger, ginko, ginseng, golden seal, gotu kola, hawthorne berry, hops, horse chestnut, horse tail, jasmine, juniper berry, kava, lady's mantle, lavender, lemon balm, licorice, marshmallow, marijuana, meadow sweet, milk thistle, mullein, mustard, myrrh, nettle, noni, oat fiber, olive, onion, oregon grape, osha, papaya, parsley, passion flower, pennyroyal, peppermint, pleurisy root, psyllium, raspberry leaves, red clover, rosemary, sage, St. John's wort, sarsaparilla, saw palmetto, shiitake mushroom, skull cap, suma, thyme, turmeric, uva ursi, valerian, white willow bark, witch hazel, yerba santo, yucca, wheat, oats, barley, corn, rice, sorghum flax, legumes, wheat grass, celery, carrot, parsnips, potato, broccoli, pepper, tea, coffee, yeast, fungi, and soybean.

31. The method of claim 21, wherein the gas includes air.

32. The method of claim 31, further including adding a processing material to the flow of gas.

33. The method of claim 21, wherein entraining the biological material in the flow of gas includes flowing the gas through a housing in a rotating and alternatingly radially outward and radially inward flow path from an inlet at one end of the housing to an outlet at an opposite end of the housing, and adding the biological material to the flowing gas at the inlet.

34. The method of claim 33, wherein within the housing there is a plurality of rotors and a stationary orifice plate having a central orifice located between each adjacent pair of the rotors, and wherein the flow of gas that entrains the biological material in the housing being created by rotating the rotors within the housing such that the biological material flows around peripheral edges of the rotors and the orifices.

* * * * *